US008607713B2

(12) United States Patent
Scholz

(10) Patent No.: US 8,607,713 B2
(45) Date of Patent: Dec. 17, 2013

(54) DEVICE FOR PIVOTING ONE OR MORE NOSE FLAPS OF A TRACK-GUIDED VEHICLE

(75) Inventor: Denny Scholz, Augsburg (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 13/588,406

(22) Filed: Aug. 17, 2012

(65) Prior Publication Data

US 2013/0042788 A1 Feb. 21, 2013

(30) Foreign Application Priority Data

Aug. 17, 2011 (EP) ..... 11177875

(51) Int. Cl.
*B61D 17/00* (2006.01)

(52) U.S. Cl.
USPC ..... 105/413; 105/392.5; 105/1.3

(58) Field of Classification Search
USPC ..... 105/1.1, 1.3, 26.05, 238.1, 280, 392.5
See application file for complete search history.

(56) References Cited

U.S. PATENT DOCUMENTS

| | | | | |
|---|---|---|---|---|
| 7,810,437 | B2 * | 10/2010 | Mattschull | 105/392.5 |
| 8,375,869 | B2 * | 2/2013 | Mayer | 105/392.5 |
| 2007/0186802 | A1 * | 8/2007 | Gough | 105/392.5 |
| 2010/0064931 | A1 * | 3/2010 | Heinisch et al. | 105/392.5 |
| 2011/0011302 | A1 * | 1/2011 | Mayer | 105/392.5 |
| 2011/0296762 | A1 * | 12/2011 | Ahrens | 49/340 |
| 2012/0291659 | A1 * | 11/2012 | Radewagen | 105/1.3 |
| 2013/0042788 | A1 * | 2/2013 | Scholz | 105/413 |
| 2013/0133547 | A1 * | 5/2013 | Heinisch et al. | 105/413 |

FOREIGN PATENT DOCUMENTS

| | | | | |
|---|---|---|---|---|
| DE | 20002278 | U1 | 6/2001 | |
| EP | 0870667 | A2 | 10/1998 | |
| EP | 2208655 | A1 * | 7/2010 | B61D 17/06 |
| EP | 2394879 | A1 | 12/2011 | |
| WO | 2007073273 | A1 | 6/2007 | |

* cited by examiner

*Primary Examiner* — Jason C Smith
(74) *Attorney, Agent, or Firm* — Fraser Clemens Martin & Miller LLC; J. Douglas Miller

(57) ABSTRACT

The invention relates to a device for pivoting one or more nose flaps of a track-guided vehicle, a railway vehicle in particular. It is hereby provided for the device to comprise at least one supporting frame (10) connected or connectable to the vehicle undercarriage and at least one actuating device connected on one side to the at least one supporting frame (10) and on the other to the pivotable nose flap (1*a;* 1*b*) for pivoting the nose flap (1*a;* 1*b*) relative to the supporting frame (10) from a closed state into an opened state and vice versa, wherein the actuating device comprises at least one lifting spindle drive (30*a,* 32*a;* 30*b,* 32*b*).

11 Claims, 2 Drawing Sheets

DEVICE FOR PIVOTING ONE OR MORE NOSE FLAPS OF A TRACK-GUIDED VEHICLE

CROSS-REFERENCE TO RELATED APPLICATION

This application claims the benefit of European Patent Application No. EP 11 177 875.9 filed Aug. 17, 2011, the entire disclosure of which is here-by incorporated herein by reference.

FIELD OF THE INVENTION

The invention relates to a device for pivoting one or more nose flaps of a track-guided vehicle, a railway vehicle in particular.

BACKGROUND OF THE INVENTION

It is known in rail vehicle technology to provide the front end of a track-guided vehicle with a protective fairing in order to protect the coupling disposed at the front end of the vehicle, and particularly the coupling head, from environmental influences such as snow, icing, moisture and dirt when the coupling is not in use and in its uncoupled state. So-called front-end modules which are mounted to the front end of the vehicle are used to this end. A front-end module normally comprises a nose flap which can pivot relative to the vehicle undercarriage and the coupling disposed on the front end of the vehicle in order to expose the coupler pocket as needed.

The term "nose flap" as used herein refers to the fairing for the coupler pocket which covers the front of the coupler pocket when in its closed state so as to protect the components of the coupler from environmental influences on the one hand and, on the other, eliminate aerodynamically disadvantageous frontal sections, which is of particular importance in the case of streamlined trainsets such as high-speed trains.

Nose flap kinematics are normally used to pivot the nose flap relative to the vehicle under-carriage, said kinematics comprising at least one actuating device and serving to expose the coupler pocket, and thus the coupling head, when needed. Doing so is then particularly required in order to bring the vehicle into a coupling-ready state or to enable access to the coupler pocket and the coupling components, for example when performing maintenance.

SUMMARY OF THE INVENTION

The task of the present invention is that of specifying a device for pivoting a nose flap with which the nose flap can be brought from a first closed position into a second opened position, wherein the device is characterized by the nose flap kinematics used to pivot the nose flap being of the simplest possible design on the one hand and, on the other, however, still able to function reliably.

This task is solved in accordance with the invention by the subject matter of independent claim 1.

According thereto, a device for pivoting one or more nose flaps of a track-guided vehicle, a rail-way vehicle in particular, is proposed, wherein the device comprises at least one supporting frame connected or connectable to the vehicle undercarriage and at least one actuating device connected on one side to the at least one supporting frame and on the other to the pivotable nose flap for pivoting the nose flap relative to the supporting frame from a closed state into an opened state and vice versa, wherein the actuating device comprises at least one lifting spindle drive.

Providing such a lifting spindle drive to effect the pivoting motion of the nose flap relative to the supporting frame provides a particularly simple to realize yet effective nose flap kinematics. This solution is characterized in particular by the nose flap kinematics requiring little maintenance. Additionally, the device can also always operate smoothly under harsh environmental conditions since the entire drive mechanism can be encapsulated within a housing.

Lifting spindle devices have a simple and low-maintenance design, whereby already established technology can in particular be drawn on in realizing the inventive solution. Even should a lifting spindle drive malfunction, the nose flap to be pivoted by the lifting spindle drive will always remain in its last pivoted position since the lifting spindle drive is self-locking.

Advantageous further developments of the inventive solution are set forth in the dependent claims.

With respect to the actuating device, it is conceivable for same to comprise an electrically, pneumatically or hydraulically operated lifting spindle drive. In this respect, the power, pneumatic or hydraulic lines which generally exist can be used to actuate the lifting spindle drive.

It is hereby particularly preferable to design the actuating device with a preferably electric servomotor to actuate the lifting spindle drive.

It is of general advantage for the lifting spindle drive to also be manually actuatable, in particular using a hand crank. Thus, the nose flap can also be pivoted in the absence of an automatic control of the lifting spindle drive, for example due to a malfunction. It is hereby of particular advantage for the actuating device to generally be equipped with a manually operable lifting spindle drive, whereby said lifting spindle drive can then be subsequently retrofitted as necessary such that it can also be actuated pneumatically, hydraulically and/or by means of an electric servomotor.

One possible realization of the lifting spindle drive provides for same to comprise a housing and a lifting spindle mounted in the housing, preferably by means of a spindle nut, wherein the lifting spindle can be extended and retracted relative to the housing when needed by actuating the lifting spindle drive. Of course, other embodiments of the lifting spindle drive are also conceivable. Particularly the providing of a spindle nut by means of which the lifting spindle is mounted in the housing of the lifting spindle drive is not absolutely imperative.

One preferred further development of the latter embodiment in which the lifting spindle drive comprises a housing as well as a lifting spindle extendable and/or retractable relative to the housing provides for the housing of the lifting spindle drive to be preferably connected to the at least one supporting frame so as to be pivotable in the vertical or horizontal plane. It is hereby of further advantage for the lifting spindle of the lifting spindle drive to be articulated to a lever element which is preferably articulated to the at least one supporting frame by means of a bearing so as to be pivotable in the vertical or horizontal plane. In a further embodiment, the lever element is thereby connected to the nose flap associated with the lifting spindle drive such that the nose flap will pivot accordingly upon the lifting spindle drive being actuated.

A particularly preferred realization of the inventive solution provides for an actuating device to pivot the nose flap, wherein the actuating device comprises a first lifting spindle drive having at least one of the above-cited features as well as a second lifting spindle drive of preferably the same design, whereby the first and the second lifting spindle drive are jointly associated with the nose flap in order to be able to pivot said nose flap when needed.

It is of particular advantage to provide a synchronizing element with this embodiment, for example in the form of a rod-shaped element, in order to be able to synchronize the movement of the first and the second lifting spindle drive as needed. Providing such a synchronizing element enables a single common drive, for example an electric servomotor, to be provided for the two lifting spindle drives coupled together by means of the synchronizing element.

One conceivable realization of the latter embodiment provides for the first and second lifting spindle drives to each comprise a spindle nut and a spindle nut-mounted lifting spindle, whereby the synchronizing element connects to the first lifting spindle drive on one side and to the second lifting spindle drive on the other.

The solution according to the invention is not limited to a device which is only able to pivot a single nose flap relative to the supporting frame. It is thus for example conceivable to also use the inventive solution to pivot a split two-piece nose flap. In conjunction hereto, it is advanta-geous to provide for a first actuating device to pivot a first nose flap as needed and a second actuating device to pivot a second nose flap as needed.

A particularly preferred realization of the latter solution provides for the first nose flap to be realized so as to pivot upward in a vertical plane relative to the supporting frame by means of the first actuating device, whereby the second nose flap is realized so as to pivot downward in a vertical plane relative to the supporting frame by means of the second actuating device. It is of course also conceivable, however, for the two nose flaps to be designed so as to each be pivotable in a horizontal plane.

BRIEF DESCRIPTION OF THE DRAWINGS

Further advantages, aspects and features of the inventive solution will become apparent from the following description of the embodiment depicted in the accompanying figures which show.

DETAILED DESCRIPTION OF EXEMPLARY EMBODIMENTS OF THE INVENTION

The following detailed description and appended drawings describe and illustrate various embodiments of the invention. The description and drawings serve to enable one skilled in the art to make and use the invention, and are not intended to limit the scope of the invention in any manner.

Figure 1:
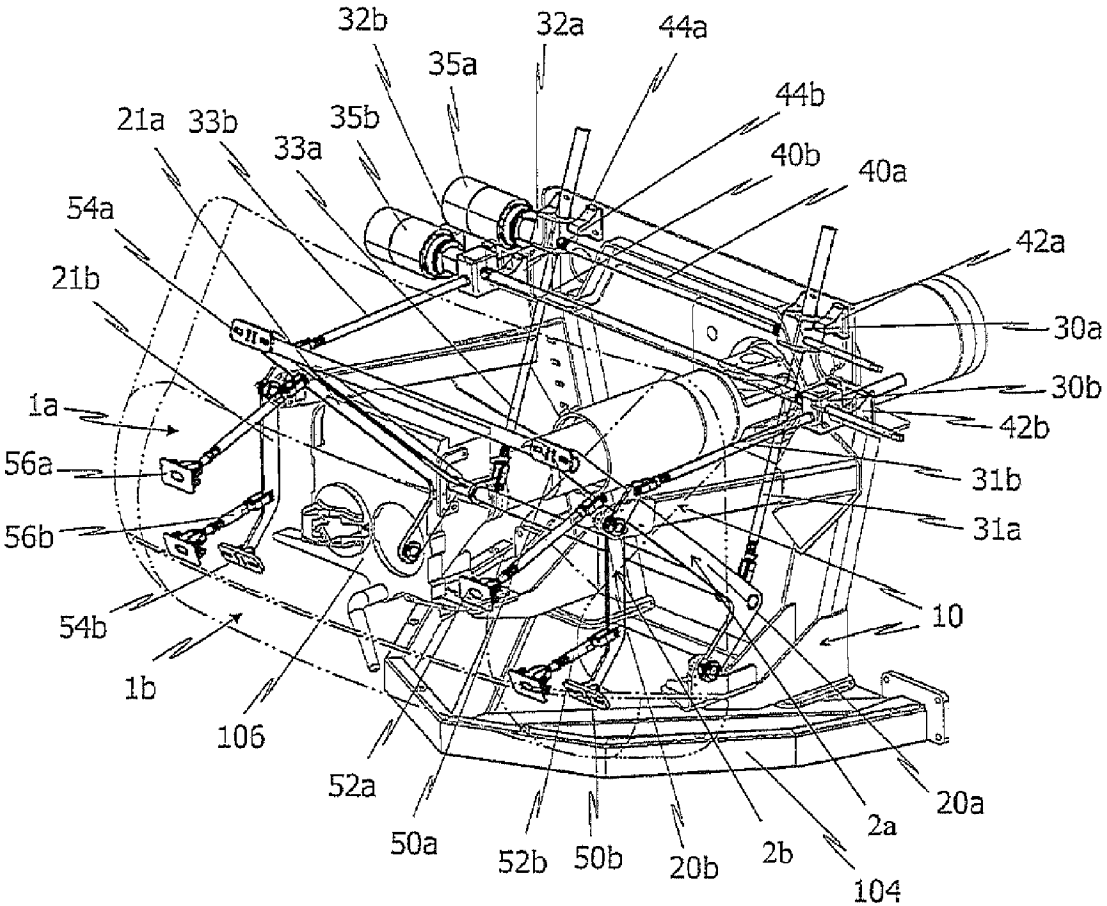
FIG. 1 a perspective view of a front-end module comprising an exemplary embodiment of an inventive device for pivoting nose flaps, wherein the two nose flaps are in a closed state.

The front-end module 100 employed in the embodiment depicted in FIG. 1 exhibits a front nose having two horizontally split nose flaps 1*a*, 1*b*. In the state shown in FIG. 2, these two nose flaps 1*a*, 1*b* are shown in their opened state; i.e. in a state in which the two nose flaps 1*a*, 1*b* are pivoted in a vertical plane relative to the vehicle undercarriage or the vehicle frame respectively. When the nose flaps 1*a*, 1*b* are in their open state, the central buffer coupling which is likewise connected to the vehicle undercarriage, preferably by means of a bearing block, becomes accessible; i.e. is in its coupling-ready state.

Figure 2:
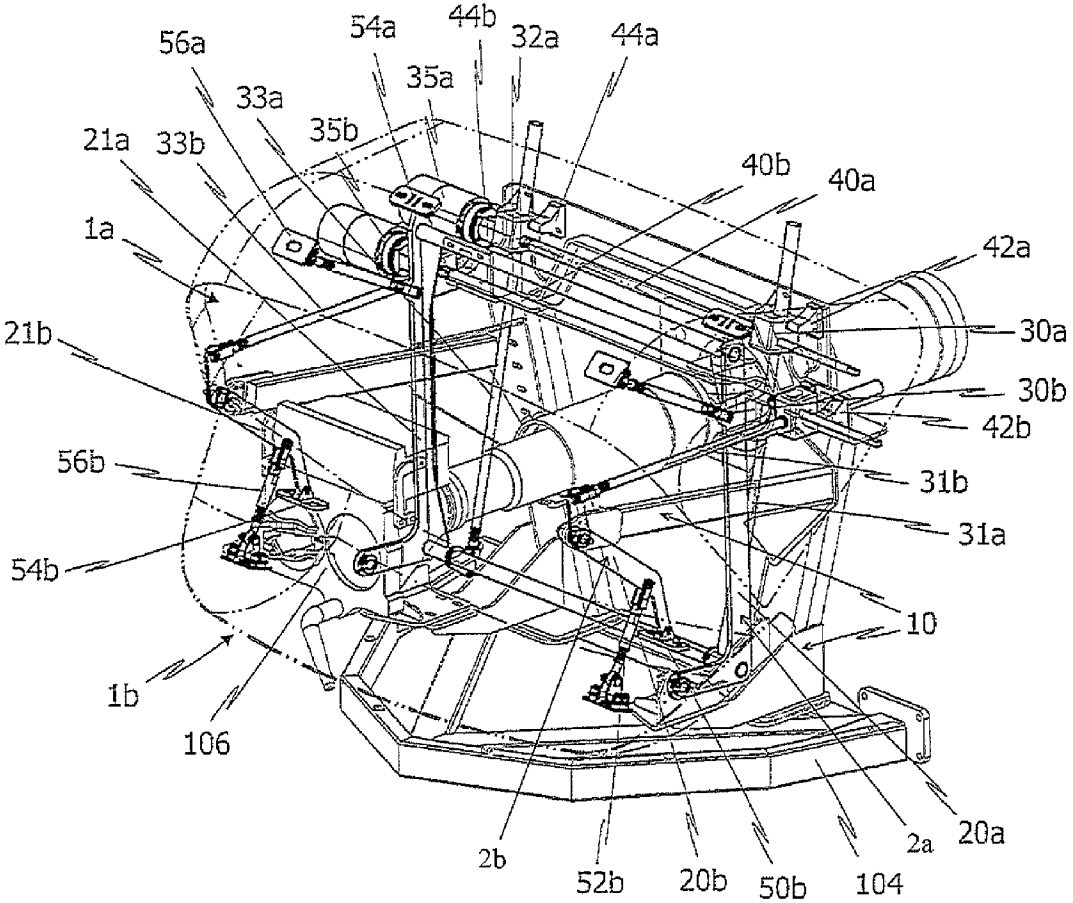
FIG. 2 a perspective view of the front-end module according to FIG. 1, wherein the two nose flaps are shown in their opened state.

The depictions provided in FIGS. 1 and 2 furthermore show the functioning of the nose flap kinematics. According thereto, the supporting frame 10 is connected to a vehicle undercarriage or vehicle frame respectively. Each of the two nose flaps 1*a*, 1*b* additionally comprise an actuating device 2*a*, 2*b* to pivot the respective nose flap 1*a*, 1*b* relative to the supporting frame 10 from a closed state (see FIG. 1) into an opened state (see FIG. 2) and vice versa. Each actuating device 2*a*, 2*b* comprises a lever element 20*a*, 21*a*, 20*b*, 21*b* which is articulated to the supporting frame 10 by means of a bearing so as to be pivotable in the vertical plane. In accordance with a not-shown variant of the embodiment of the inventive device for pivoting nose flaps, it is of course also possible for same to comprise a lever element articulated to the supporting frame so as to be pivotable in the horizontal plane in order to be able to pivot the nose flaps sideways.

In detail, the embodiment of the device for pivoting nose flaps as depicted in FIGS. 1 and 2 comprises two lever elements 20*a*, 21*a*, 20*b*, 21*b* per respective actuating device 2*a*, 2*b* or nose flap 1*a*, 1*b* respectively. The two lever elements are each coupled together as shown by means of a synchronizing element, It is of course also alternatively conceivable for the two lever elements to each be controlled independently of one another; i.e. not coupled by means of a synchronizing element. At each end facing the respective nose flap 1*a*, 1*b*, the lever elements 20*a*, 21*a*, 20*b*, 21*b* exhibit an end flange 50*a*, 50*b*, 54*a*, 54*b* which serves to detachably fix the lever elements 20*a*, 21*a*, 20*b*, 21*b* to the respective nose flaps 1*a*, 1*b*. Additionally to the end flange 50*a*, 50*b*, 54*a*, 54*b*, at least one pivotable support element 52*a*, 52*b*, 56*a*, 56*b* can be provided on the respective lever elements 20*a*, 21*a*, 20*b*, 21*b*, same likewise being detachably connected to one of the two nose flaps 1*a*, 1*b* via a flange region.

Each of the actuating devices 2*a*, 2*b* depicted in FIGS. 1 and 2 for pivoting the respective nose flap 1*a*, 1*b* is equipped with a total of two lateral lifting spindle drives 30*a*, 32*a*, 30*b*, 32*b*. Each lifting spindle drive 30*a*, 32*a*, 30*b*, 32*b* comprises a housing and a lifting spindle 31*a*, 33*a*, 31*b*, 33*b* mounted in said housing, preferably by means of a spindle nut, wherein the lifting spindles 31*a*, 33*a*, 31*b*, 33*b* are extendable and retractable relative to the housing as needed upon the respective lifting spindle drive 30*a*, 32*a*, 30*b*, 32*b* being actuated. In the embodiment depicted, the housing of each lifting spindle drive 30*a*, 32*a*, 30*h*, 32*b* is connected to the supporting frame 10 by means of a bearing 42*a*, 42*b*, 44*a*, 44*b* so as to be pivotable in the vertical plane.

The lifting spindle 31*a*, 33*a*, 31*b*, 33*b* of each lifting spindle drive 30*a*, 32*a*, 30*b*, 32*b* is articulated to a respective lever element 20*a*, 21*a*, 20*b*, 21*b*, wherein the respective lever element 20*a*, 21*a*, 20*b*, 21*b* is connected to the nose flap 1*a*, 1*b* associated with said lifting spindle drive 30*a*, 32*a*, 30*b*, 32*b* such that the nose flap 1*a*, 1*b* is pivoted upon the lifting spindle drive 30*a*, 32*a*, 30*b*, 32*b* being actuated. The translational movement of the lifting spindle 31*a*, 33*a*, 31*b*, 33*b* produced by the lifting spindle drive 30*a*, 32*a*, 30*b*, 32*b* is thereby transmitted to the lever element 20*a*, 21*a*, 20*b*, 21*b*, resulting in a pivoting motion of the end flange 50*a*, 50*b*, 54*a*, 54*b* as well as the support element 52*a*, 52*b*, 56*a*, 56*b* and, consequently, the nose flap 1*a*, 1*b*.

It is in principle conceivable for the lifting spindle drives 30*a*, 32*a*, 30*b*, 32*b* of the two actuating devices 2*a*, 2*b* to be actuated electrically, pneumatically or hydraulically. In the embodiment depicted, each of the actuating devices 2*a*, 2*b* is provided with an electric servomotor 35*a*, 35*b* in order to actuate the corresponding lifting spindle drive 30*a*, 32*a*, 30*b*, 32*b*. Utilizing an electric servomotor 35*a*, 35*b* allows the nose flaps 1*a*, 1*b* to be pivoted into different positions. Accordingly, the nose flaps 1*a*, 1*b* can not only be varied between the "fully open" and "fully closed" positions but can also be set into a "partly opened" position, for example. So as to be able to better control the pivoting motion of the nose flaps 1*a*, 1*b*, the affixing of end stops (not shown) for the lever elements 20*a*, 21*a*, 20*b*, 21*b* on the support frame 10 can be additionally provided.

As depicted, each actuating device 2*a*, 2*b* comprises a single electric servomotor 35*a*, 35*b* which serves to actuate both lifting spindle drives 30*a*, 32*a*, 30*b*, 32*b* of the actuating device 2*a*, 2*b*. A synchronizing element 40*a*, 40*b* in the form of a rod-shaped element is used in the process to synchronize the actuating of the two lifting spindle drives 30*a*, 32*a*, 30*b*, 32*b* of one actuating device 2*a*, 2*b*. Actuating of the electric servomotors 35*a*, 35*b* rotates the rod-shaped synchronizing element 40*a*, 40*b*, whereby the lifting spindle drives 30*a*, 32*a*, 30*b*, 32*b* are simultaneously powered and effect a synchronous moving of the lifting spindles 31*a*, 33*a*, 31*b*, 33*b*.

The electric servomotors 35*a*, 35*b* of the actuating devices 2*a*, 2*b* are provided on one side and each provided with end position sensors. It is of course also conceivable to provide an electric servomotor on both sides of the synchronizing element 40*a*, 40*b* in order to provide a redundant drive mechanism. In the embodiment depicted, the lifting spindle drives 30*a*, 32*a*, 30*b*, 32*b* of an actuating device 2*a*, 2*b* can also be actuated manually, for example in emergency operation, by means of a hand crank. Service flaps can be provided on the sides of the front-end module for this purpose which allow access to the actuating device 2*a*, 2*b* via a hand crank.

The solution according to the invention is not limited to the exemplary embodiment depicted in the figures but rather yields from a synopsis of all the features disclosed herein.

From the foregoing description, one ordinarily skilled in the art can easily ascertain the essential characteristics of this invention and, without departing from the spirit and scope thereof, make various changes and modifications to the invention to adapt it to various usages and conditions.

What is claimed is:

1. A device for pivoting one or more nose flaps of a track-guided vehicle, wherein the device comprises the following:

at least one supporting frame connected or connectable to an undercarriage of the track-guided vehicle;

at least one actuating device connected to the at least one supporting frame and connected to a pivotable nose flap for pivoting the nose flap relative to the supporting frame from a closed state into an opened state and vice versa, wherein the actuating device comprises a first lifting spindle drive and a second lifting spindle drive, whereby the first lifting spindle drive and the second lifting spindle drive are configured to pivot the nose flap; and a synchronizing element in the form of a rod-shaped element configured to synchronize actuation of the first lifting spindle drive and the second lifting spindle drive.

2. The device according to claim 1, wherein the actuating device comprises an electrically, pneumatically or hydraulically operated first lifting spindle drive and an electrically, pneumatically or hydraulically operated second lifting spindle drive.

3. The device according to claim 1, wherein the actuating device comprises a servomotor to actuate one of the first lifting spindle drive and the second lifting spindle drive.

4. The device according to claim 1, wherein the first lifting spindle drive and the second lifting spindle drive can be actuated manually.

5. The device according claim 1, wherein each of the first lifting spindle drive and the second lifting spindle drive comprises a housing and a lifting spindle mounted in the housing, wherein the lifting spindle can be extended and retracted relative to the housing by actuating the respective lifting spindle drive.

6. The device according to claim 5, wherein the housing of the lifting spindle drive is connected to the at least one supporting frame so as to be pivotable in the vertical or horizontal plane.

7. The device according to claim 5, wherein the lifting spindle is articulated to a lever element which is articulated to the at least one supporting frame by means of a bearing so as to be pivotable in the vertical or horizontal plane.

8. The device according to claim 7, wherein the lever element is connected to the nose flap associated with the respective lifting spindle drive such that the nose flap will pivot upon actuation of the respective lifting spindle drive.

9. The device according to claim 1, wherein the first lifting spindle drive and the second lifting spindle drive each comprises a spindle nut and a spindle nut-mounted lifting spindle, and wherein the synchronizing element connects to the first lifting spindle drive on one side and to the second lifting spindle drive on the other.

10. The device according to claim 1, wherein a first actuating device is provided to pivot a first nose flap and a second actuating device is provided to pivot a second nose flap.

11. The device according to claim 10, wherein the first nose flap is designed so as to pivot upward in a vertical plane relative to the supporting frame by means of the first actuating device, and wherein the second nose flap is designed so as to pivot downward in a vertical plane relative to the supporting frame by means of the second actuating device.

* * * * *